US006202264B1

(12) United States Patent
Ishihara

(10) Patent No.: US 6,202,264 B1
(45) Date of Patent: Mar. 20, 2001

(54) SURFACE FASTENER MADE OF FIBER AND METHOD FOR MANUFACTURING THE SAME

(75) Inventor: Mitsutoshi Ishihara, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/251,956

(22) Filed: Feb. 17, 1999

(30) Foreign Application Priority Data

Mar. 6, 1998 (JP) ..... 10-055035
Mar. 6, 1998 (JP) ..... 10-055049

(51) Int. Cl.[7] ..... A44B 18/00; B32B 3/00
(52) U.S. Cl. ..... 24/445; 24/442; 24/446; 24/452
(58) Field of Search ..... 24/445, 446, 450, 24/451, 452, 442

(56) References Cited

U.S. PATENT DOCUMENTS 3,594,873 * 7/1971 Hockmeyer, Jr. ..... 24/445
3,849,840 * 11/1974 Yamada et al. ..... 24/204
5,515,583 * 5/1996 Higashinaka ..... 24/446
5,656,351 * 8/1997 Donaruma ..... 24/442
5,659,930 * 8/1997 Okawa ..... 24/445
5,688,579 * 11/1997 Konsti et al. ..... 428/192
5,745,961 * 5/1998 Okawa et al. ..... 24/446

FOREIGN PATENT DOCUMENTS

5154009 * 6/1993 (JP) ..... 24/445

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

The present invention provides a surface fastener made of a woven/knitted fabric which is extremely thin and flexible. Designs and the like on a rear face side of the fastener can be clearly seen through engaging elements and a substrate. Also, the fastener has a high productivity, thereby allowing a rational price setting. In a surface fastener made of a fiber woven/knitted fabric including a large number of female and/or male engaging elements which are woven simultaneously with weaving of a ground woven/knitted fabric formed of a ground structure and which project from a surface of the woven/knitted fabric, all of warp and weft constituting the ground structure and a yarn constituting the engaging elements are made of monofilament, synthetic resin applied to a rear face of the ground woven/knitted fabric adheres intensively to crossing portions of the monofilaments constituting the warp, the weft, and the engaging elements, and gaps are formed between weaving/knitting structure of the monofilaments constituting the warp, the weft, and the engaging elements.

17 Claims, 7 Drawing Sheets

SURFACE FASTENER MADE OF FIBER AND METHOD FOR MANUFACTURING THE SAME

BACKGROUND OF THE INVENTION

1. Field of the Invention

The present invention relates to a surface fastener made of fiber comprising at least a large number of engaging elements woven/knitted into a surface of a woven/knitted fabric obtained by weaving/knitting, the engaging elements being woven/knitted simultaneously with weaving/knitting of the woven/knitted fabric, and to a method for manufacturing the fastener.

2. Description of the Related Art

The surface fastener of this type generally comprises a male engaging member having a large number of hook-shaped or mushroom-shaped male engaging elements formed to stand on a surface of a flat substrate and a female engaging member having a large number of loop-shaped female engaging elements rising in close contact with each other on a flat substrate. By setting the female and male engaging members with their faces on which the engaging elements are formed facing each other and by pushing the male and female members against each other, the male and female engaging elements are engaged with each other to join the male and female engaging members to each other. By peeling the male and female engaging members from each other, the engaged male and female engaging elements are detached from each other.

The surface fastener having the above structure is applied to extremely many fields from daily necessities to industrial material. In recent years, a molded surface fastener made of synthetic resin and obtained by integrally and simultaneously molding fine male engaging elements and a flat substrate has taken the place of a woven or knitted surface fastener and has been put to actual use. The molded surface fastener has been used as fasteners of various diapers and sanitary napkins which are liable to be in direct contact with user's skin.

The most general structure of the female engaging member to be engaged with and detached from the male engaging member is a so-called pile woven/knitted fabric having a large number of loops formed to stand on a ground structure of the woven/knitted fabric made of fiber. The piles (loops) are usually obtained by weaving or knitting multifilament into the ground structure of the pile woven/knitted fabric. As another type of female engaging member, a general non-woven cloth having a surface dense with fine piles has come to be used, as the above fine engaging elements of the integrally molded surface fastener has been put to actual use.

As warp and weft constituting yarns of a substrate woven/knitted fabric for weaving, fixing, and supporting the male or female engaging elements, a twine made of multifilament or a normal spun yarn is used. A purpose for this is to further firmly hold monofilament or multifilament forming the male or female engaging elements by a weaving/knitting structure formed of warp and weft and to prevent the engaging elements from falling out of the substrate, by utilizing a friction force of a rough surface of the twine and flexibility of the twine in a shearing direction. Therefore, a density of weaving of the substrate is naturally set at a large value.

Japanese Patent Publication No. 55-38121 discloses an example wherein the loops as the female engaging elements are formed of a single yarn of 90 d made of the twine of multifiber. In a surface fastener disclosed in this Japanese Patent Publication, warp and weft constituting yarns of the ground structure of the woven fabric are formed of twines made of multifiber. A single rubber yarn is used as a part of the warp, and the ground structure is woven while stretching the rubber yarn. The loops as the female engaging elements and the loops to be used for the hooks as the male engaging elements are firmly tied and fixed to the ground structure by contraction of the woven rubber yarn when weaving is finished.

On the other hand, the variety of use of the surface fastener of this type is further increased. In the same industrial field, there is a strong need for a surface fastener which fits for material, a structure, or a color of clothes in a field of clothes, for example, wherein a fashion sense is required. Particularly, the surface fastener has recently come to be used frequently not only for underwear but also for outerwear. In thin clothes made of a lace fabric, for example, the surface fastener itself is required to be thin and to have transparency and flexibility throughout the fastener so as to be adapted to the material or structure of the clothes. Further, in addition to the above needs, there is a need for a surface fastener which is thin and has a strong engaging force in a large field of engaging and detaching devices for various outerwear and bags, for example. Also, in a fastener portion of various sportswear and bags, for example, it is required to see and recognize various designs and colors of a logotype and the like on the clothes or bags through the surface fastener, even if the fastener is thick.

In the surface fastener disclosed in the above Japanese Patent Publication, however, the density of weaving of the substrate is increased by using the rubber yarn, and the majority of the used yarns is twine. Therefore, it is impossible to obtain a thin and flexible surface fastener. In addition, as is apparent from another example disclosed in the above Japanese Patent Publication, a large number of piles are densely formed to stand on the surface of the flat substrate made of fiber particularly in the female engaging member of the conventional surface fastener, as described above. As a result, a rear side of the surface fastener can not be seen through due to the piles densely formed on a front face of the fastener, and this defect can not be overcome even if any thought is put into designing the flat substrate.

Therefore, conventionally, desired designs, letters, or marks are applied to a surface of a product including a surface of a surface fastener after the fastener is mounted to the product, or necessary designs are applied to the surface of the surface fastener in advance. In the former case, various problems based on a difference in dyeing properties of the surface fastener and a member of clothes and the like to be mounted with the fastener are liable to be generated, and in addition, two steps of operation are required to apply designs and the like. In the latter case, a number of steps is increased, and in addition, positioning of the designs on the surface fastener to the designs on the product in mounting of the fastener is complicated, thereby significantly decreasing a producing efficiency. Furthermore, shapes of the designs on the pile face are easily deformed, the designs on the pile face may be displaced from the designs on the clothes body over time, and a difference in clearness of colors of designs on the clothes body and the fastener is liable to be generated.

SUMMARY OF THE INVENTION

The present invention has been accomplished to solve the above problems, and it is a first object of the invention to provide an extremely thin and flexible surface fastener made of fiber. It is a second object of the invention to provide a surface fastener wherein a design and the like on a rear face side can be clearly seen through engaging elements and a substrate. It is a third object of the invention to provide a surface fastener wherein a manufacturing efficiency of the surface fastener is improved so as to increase productivity, thereby allowing a rational price setting.

The above objects can be achieved by the inventions described below.

The present inventors have found that a constituting member which has conventionally been left out of consideration in a surface fastener made of fiber is the most suitable for solving the above problems as a result of a hard study. In other words, in the conventional surface fastener made of fiber, it has been considered that an engaging rate of the female engaging elements with the hooks as opposed male engaging elements is increased and a peeling strength is increased by densely forming as large number of piles as possible.

On the other hand, it has been considered to be desirable to increase a density of weaving of the substrate and to firmly bind base ends of the engaging elements by warp and weft in order to fix the male or female engaging elements to the substrate. However, it has become clear that fixing of the base ends of the engaging elements to the substrate depends on back coating rather than the density of weaving of the substrate. Therefore, it is unnecessary to use twine as warp and weft which are constituting material of the substrate.

As a result of further study, it has been found that a sufficient engaging force and peeling strength with the opposed male engaging elements can be ensured even if the loops (piles) formed to stand on the surface of the flat substrate are formed of monofilament as far as a shape of the pile is maintained as described above.

Thus, in order to stably maintain the loops on the surface of the substrate keeping the shape of the piles, synthetic resin is coated on the rear face of the flat substrate to fix the base ends of the loops to the substrate in general as disclosed in the above Japanese Patent Publication. However, the surface fastener of this type is engaged and peeled frequently and repeatedly in most cases, and a securing function may be lost in a short term if the securing by the synthetic resin is weak. In order to prevent this, it is necessary to increase an amount of the synthetic resin to be coated on the rear face of the substrate. Increase of the amount of the synthetic resin decreases flexibility of the flat substrate, and in addition, decreases transparency of the flat substrate even in a case the substrate is formed to be thin. This means that the fastener can not keep up with the above increase in variety of the surface fastener, and its application is limited.

Therefore, the present inventors have studied further and found that loops wherein a shape of piles can be kept with sufficient durability can be formed by appropriately selecting quality of material of synthetic resin to be coated and of respective yarns constituting the surface fastener and by appropriately coating synthetic resin on the rear face of the substrate, even if the amount of the synthetic resin to be coated on the rear face of the substrate is decreased.

According to a first aspect of the invention, there is provided a surface fastener made of fiber including a large number of engaging elements which are woven/knitted simultaneously with weaving/knitting of a ground woven/knitted fabric formed of a ground structure and which project from a surface of the woven/knitted fabric, wherein all of yarns constituting the ground structure and a yarn constituting the engaging elements are made of monofilament.

The surface fastener made of fiber of the invention includes a surface fastener wherein a large number of male or female engaging elements are solely formed to stand on a surface of the woven/knitted fabric and a so-called self engaging type of surface fastener which itself can be engaged and detached wherein male and female engaging elements exist in a mixed state.

The most remarkable feature of the invention is that all of the warp and the weft constituting the ground structure and the yarn constituting the engaging elements are made of the monofilament. By using the monofilament for all the constituting yarns of the surface fastener, a preparing step of weaving/knitting is made simple, thereby increasing a productivity. Simultaneously, by selecting a fineness (thickness) of each the constituting yarn streak, a Hook-and-Loop fastener with any thickness such as a thick fastener or an extremely thin fastener can be arbitrarily manufactured. Furthermore, by setting a weaving density at a low value, gaps can be formed in the weaving/knitting structure formed of the monofilaments for the warp, the weft, and the engaging elements. Also, in the female surface fastener, because the engaging elements are formed of the monofilament, transparency can be ensured.

Preferably, in order to firmly secure the male and/or female engaging elements made of monofilaments to the ground woven/knitted fabric and to ensure transparency, synthetic resin applied to a rear face of the ground woven/knitted fabric adheres intensively to crossing portions of the monofilaments constituting the warp, the weft, and the engaging elements, and gaps are formed in weaving/knitting structure of the monofilaments constituting the warps, the wefts, and the engaging elements.

Preferably, the engaging elements include a large number of female engaging elements, the monofilament constituting the female engaging elements has a self torsion property, and torsion is generated in base end portions of the female engaging elements projecting from the woven/knitted fabric.

In the present invention, the female engaging elements are made of monofilament, torsion is generated in the projecting base end portions of loops formed by weaving or knitting the monofilament into the ground structure due to the self torsion property, and the loop itself holds the warp or the weft under which the monofilament of the loop passes. Therefore, the female engaging element itself has a property for maintaining the shape. Thus, when synthetic resin is coated on the rear face of the substrate, for example, an amount of the resin to be coated can be extremely small as compared with that in conventional art.

Further preferably, the monofilament for the female engaging elements has a sectional shape of a polygon with three or more angles. If the monofilament has a triangular shape in section, edge portions (edge lines) of the monofilament are rubbed by other members in weaving or knitting, and torsion is automatically generated in the projecting base end portions of the loops formed of the monofilament after weaving or knitting. Therefore, the invention does not require a special treatment for causing the loops to exhibit their self torsion property.

Still preferably, the monofilament for the female engaging elements is crimped when heated. A heating treatment as a heating treatment for setting or a finishing processing is necessarily applied to the surface fastener made of fiber of this type after weaving or knitting. In the present invention, when the heating treatment is applied to the fastener, self torsion is generated in the base end portion of the loop formed of the monofilament projecting from the substrate due to crimp. The monofilament having such a crimping property can be manufactured by combining and spinning fiber material with high shrinking property and fiber material with low shrinking property arranged side by side. The quality of material is obtained by combining various kinds of thermoplastic synthetic resin, but it is desirable that combined kinds of material have affinity with each other. Such quality of material is obtained by combining and spinning normal polyester and metamorphic polyester, for example.

Preferably, the engaging elements are a large number of male engaging elements so that the obtained surface fastener is a male surface fastener. A shape of the male engaging element may be a hook shape, or a mushroom shape.

The surface fastener may be a so-called self engaging type of surface fastener made of fiber, wherein the large number of engaging elements comprise loop-shaped female engaging elements and hook-shaped or mushroom-shaped male engaging elements, and the female and male engaging elements exist in a mixed state.

A preferred range of fineness (thickness) of each monofilament as constituting material of the surface fastener are defined as follows. Finenesses of the yarns constituting the ground structure are in a range of 2 d to 100 d. A fineness of the monofilament constituting the female engaging elements is in a range of 2 d to 70 d. In a normal surface fastener made of fabric as disclosed in the above Japanese Patent Publication, a warp constituting the ground structure is a twine of 140 d made of multifiber, a weft is a twine of 200 d made of multifiber, and a loop yarn constituting the female engaging elements is a twine of 90 d. Thus, as compared with this normal fastener, it would be understood that a fineness of any yarn used in the invention which is a combination of the above mentioned features is remarkably small. Such monofilaments with small finenesses can be used mainly because of the above property of the female engaging element for maintaining its shape.

A fineness of the monofilament constituting the male engaging elements is preferably in a range of 70 d to 300 d. Alternatively, the fineness of the monofilament constituting the male engaging elements may be in a range of 100 d to 150 d.

A preferred fineness (thickness) of each constituting yarn of the self engaging type of surface fastener is defined as follows. Finenesses of the yarns constituting the ground structure are in a range of 2 d to 100 d, a fineness of the monofilament constituting the female engaging elements is in a range of 2 d to 70 d, and a fineness of the monofilament constituting the male engaging elements is in a range of 70 d to 300 d.

The fineness of the monofilament as the constituting yarn for the male engaging elements is in a range of 70 d to 300 d so as to ensure a necessary engaging force of the male engaging elements with the female engaging elements, and the fineness of the monofilament for the male engaging elements is properly determined according to usage of the surface fastener and the fineness of the female engaging elements.

By combining the finenesses in the above ranges, an engaging strength and a peeling strength which are necessary to the surface fastener can be obtained, and a surface fastener which is thin and flexible and wherein a rear face can be seen through from a front face of the fastener can be obtained.

In a case the surface fastener is especially formed of a woven fabric, the ground structure is formed of a weaving structure comprising warp and weft, a fineness of the warp is in a range of 2 d to 100 d, and a fineness of the weft is in a range of 30 d to 100 d. The fineness of the warp which is further desirable to obtain a thinner surface fastener is in a range of 15 d to 70 d.

And preferably, all of the monofilaments are made of transparent or semitransparent material so as to ensure further transparency such that the rear face of the surface fastener can be reliably seen through.

According to a second aspect of the invention, there is provided a method for manufacturing a surface fastener made of fiber according to the first aspect comprising only the male or female engaging elements or the mixed male and female engaging elements. The method comprises the steps of weaving or knitting the monofilament which is constituting material of female and/or male engaging elements while forming loops on a surface of the ground woven/knitted fabric simultaneously with weaving/knitting of the ground woven/knitted fabric by using the yarns made of monofilament, thermally setting the completed woven/knitted fabric to fix a weaving/knitting shape, coating synthetic resin material on a rear face of the set woven/knitted fabric to form a thin film, spraying air on the film in a direction from the rear face side to a front face side of the woven/knitted fabric to concentrate the film on crossings of respective constituting yarns of the woven/knitted fabric, and forming gaps by the concentration of the film through the surface fastener in a direction from the front face to the rear face between the respective constituting yarns.

Preferably, the method further includes a step of cutting a portion of each of the loop which is constituting material of the male engaging element, the step being the most typical method for forming the male engaging element. The shape of the male engaging element is not limited to the hook-shaped male engaging element obtained by the above manufacturing method, but the male engaging element may be a so-called mushroom-shaped male engaging element obtained by melt cutting a top of a loop for the male engaging element woven as described above and providing a hemispheric engaging head to a tip end of the cut loop, for example.

DESCRIPTION OF THE PREFERRED EMBODIMENTS

Figure 1:
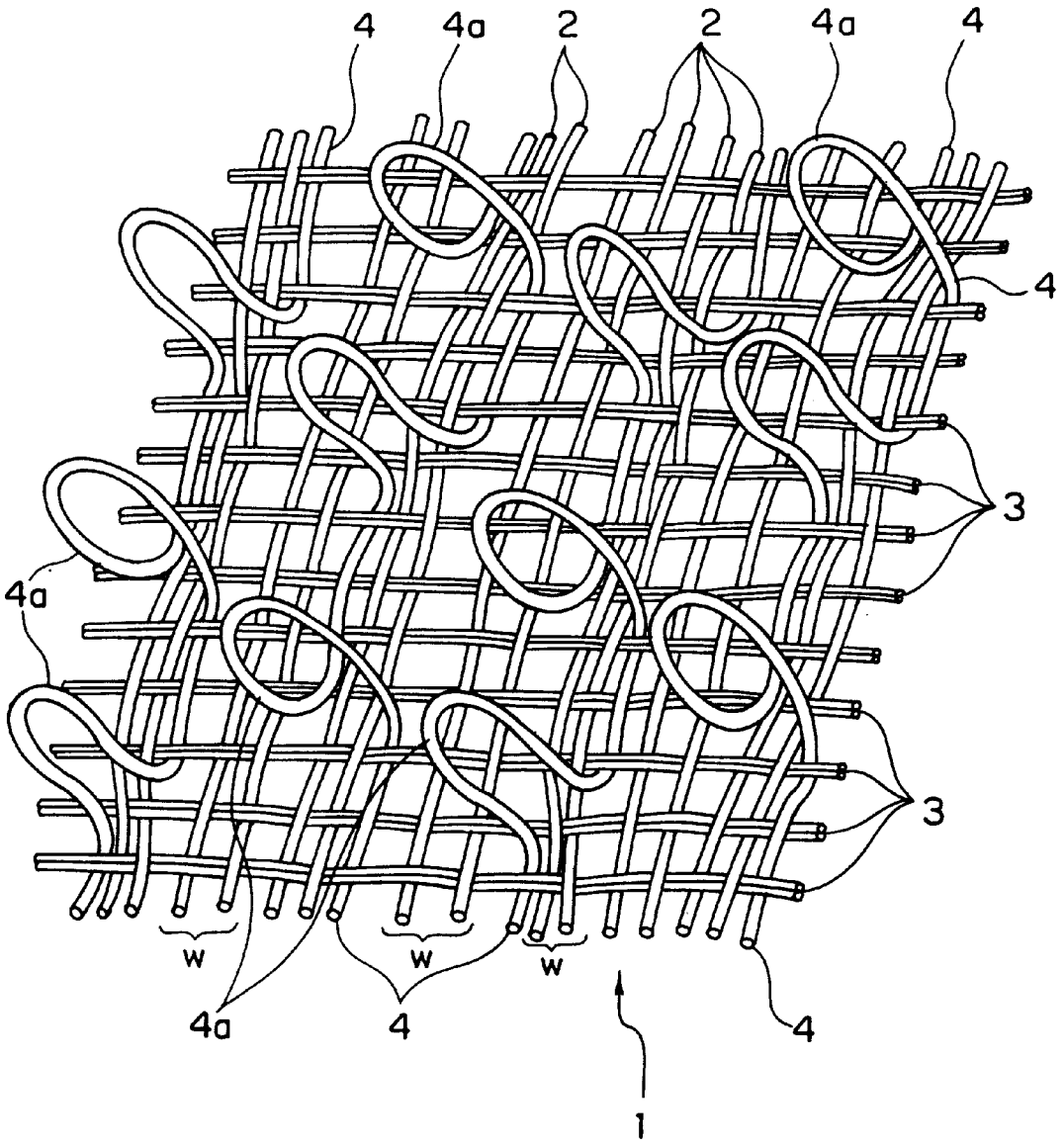
FIG. 1 is a perspective view of a portion of a female surface fasten of a first embodiment of the present invention.

Preferred embodiments of the present invention will be specifically described below based on examples shown in the drawings.

FIG. 1 is a perspective view of a portion of a first embodiment having a woven/knitted fabric structure of a woven surface fastener according to the present invention. The first embodiment gives an example wherein the woven surface fastener is a female surface fastener having a large number of loops formed on a surface of a ground structure. FIG. 1 shows ground woven fabric 1, warp 2, weft 3, and monofilament 4 for female engaging elements.

The example shown in FIG. 1 only shows a representative embodiment of the invention, and a weaving structure is not limited to the shown example. The surface fastener made of fiber of the invention is not limited to a woven fabric, but may be formed by warp knitting combining warp yarn and weft in-laid yarn or two needle stitch and tricot, for example.

In the female surface fastener of the present embodiment, the ground woven/knitted fabric 1 is formed of a plain weaving structure comprising the warp 2 and the weft 3. As the warp 2 which characterizes the present invention, monofilament of 30 d is used, and monofilament of 30 d is similarly used as the weft 3. In FIG. 1, the weft 3 is ply yarn formed of two monofilaments because weft laying of the embodiment is carried out by a carrier of a narrow loom, and thus, a double pick is employed wherein reciprocating weft laying is carried out for one opening, and a single monofilament is used for one weft laying. Therefore, if a normal loom is used, each weft 3 is completely formed of a single monofilament.

In the embodiment, a single monofilament 4 is used as a yarn for female engaging elements woven into the ground woven/knitted fabric 1, which characterizes the present invention, although a multifilament has conventionally been used for the yarn for the female engaging elements. The monofilament 4 is woven into the ground woven/knitted fabric 1 while forming loops 4*a* as the female engaging elements. In the embodiment, a fineness of the monofilament 4 for the female engaging elements is 30 d.

Polyester is used for all of the warp 2, the weft 3, and the monofilament 4 for the female engaging elements 4*a* in the embodiment. However, it is possible to use one of or a combination of kinds of thermoplastic synthetic resin material such as polyamide and polypropylene which are usually used for the surface fastener of this type. In the embodiment, finenesses of the respective yarns are set as described above and polyester with a high transparency is used so as to ensure transparency of the surface fastener. It is not an only object of the invention to ensure transparency, but the invention is based on the premise that monofilament is used as yarn for the female engaging elements taking productivity and cost efficiency into consideration.

Because weft 3 is woven in by using the carrier in weaving of the embodiment, one yarn reciprocates in the same opening of the warp. Therefore, the weft 3 is constantly in a state of ply yarn wherein two yarns are put together. Thus, the fineness of the weft 3 will be doubles. In the present embodiment, a count of wefts 3 per an inch is in a range of 57 to 58 which is considerable as compared with usual 52/in. However, transparency is ensured because monofilaments as the constituting yarns with extremely small finenesses as compared with those of conventional yarns are used as described above, and because gaps are ensured between warps and wefts in spite of the above-described density of weaving. A density of warp in the embodiment is in a range of 120 to 130/in, but the densities of weft and warp may be determined based on usage of the surface fastener of the invention. Because the fineness is small, the obtained surface fastener is extremely thin throughout the fastener.

Next, a specific example of a structure of woven fabric of the surface fastener of the invention woven by using yarns with the above structure will be described based on FIG. 1.

In FIG. 1, monofilament of 30 d is used for warp 2 and weft 3 as constituting yarns of the ground woven fabric 1 and for monofilament 4 as constituting yarn of the female engaging elements. Because the weft 3 is ply yarn as described above, the fineness of the weft 3 is 60 d. A structure of the ground woven/knitted fabric 1 is formed of the plain weaving structure comprising warp 2 and weft 3. The monofilament 4 is woven while forming the loop 4*a* as the female engaging element every time it goes across a warp line w comprising adjacent two warps 2. In this case, the loops 4*a* of the monofilament 4 are successively formed by the monofilament 4 passing under a first weft 3, over a second weft 3, then under a third weft 3, and going across an adjacent warp line w and passing under the next weft 3 as is apparent from FIG. 1. Such a structure of woven/knitted fabric is a general weaving structure of a conventional male surface fastener. After the monofilament 4 which is the constituting yarn of the female engaging elements is woven into three wefts 3, the monofilament 4 passes over the warp line w to form a new loop 4*a*.

Of course, the weaving structure shown in FIG. 1 is only an example of the present invention, and it is also possible to form a loop of the monofilament 4 at every other weft 3, for example. In this case, a density of the loop increases and an engaging rate between the female engaging elements and opposed male engaging elements increases. In this weaving structure, it is further desirable to form each loop 4*a* by the monofilament 4 passing over the warp line w comprising two warps 2 in a zigzag manner in order to direct the loops 4*a* in various directions.

The woven fabric woven as described above is thermally set on the loom according to a general process to fix a structure of the ground woven structure and a shape of the loops 4*a*. Then, resin is coated on the rear side to secure base portions of the loops 4*a* to the ground woven fabric 1. In order to ensure flexibility and transparency in addition to stability of the loop shapes, it is desirable to use resin material which is highly adhesive to the respective constituting yarns and which is of the same kind as the respective constituting yarns, to coat as small amount as possible of the resin, and to concentrate the resin on contact portions of projecting base portions of the loops 4*a* with the ground wove fabric 1.

Figure 2:
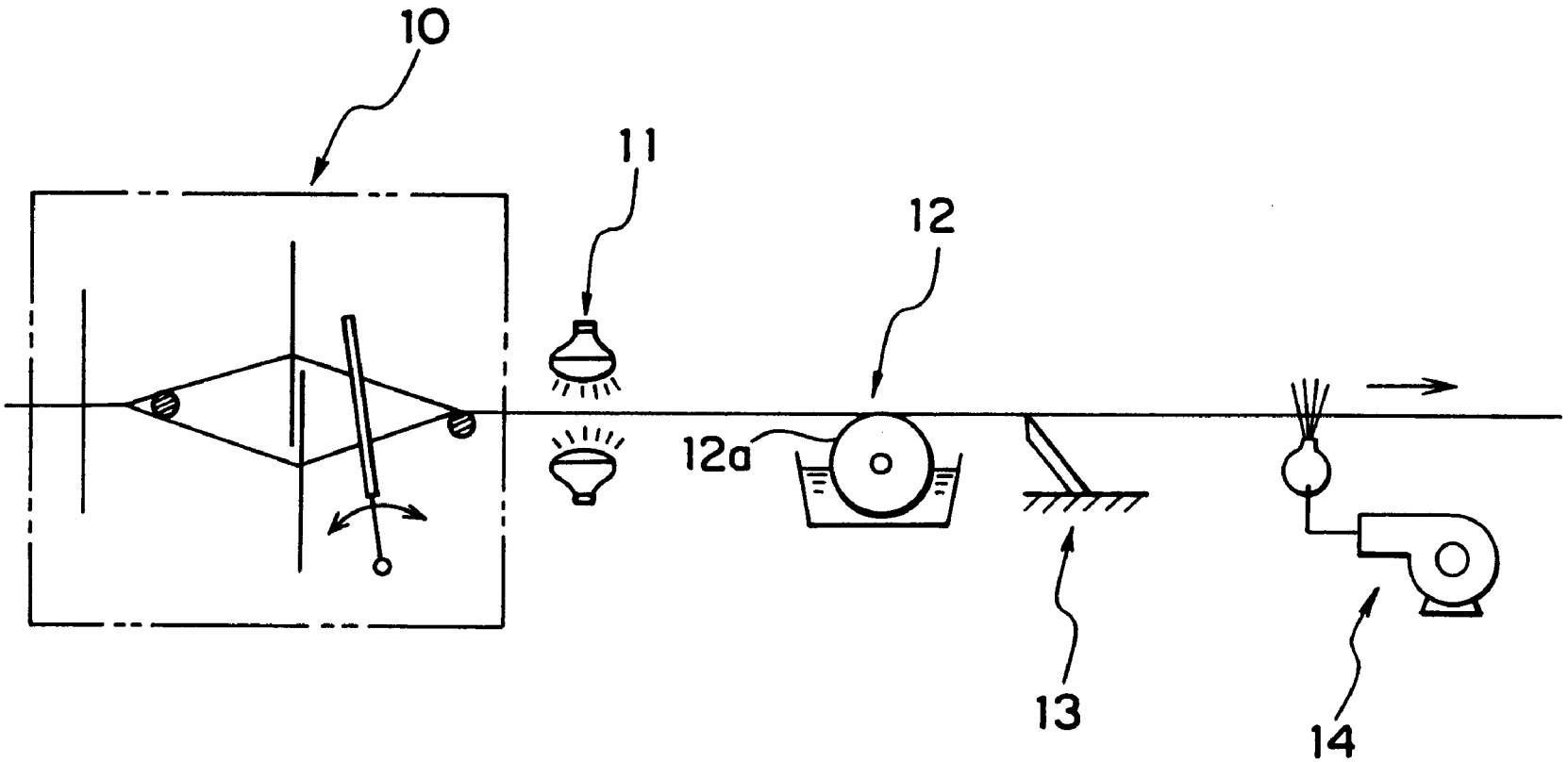
FIG. 2 illustrates disposition of facilities to show an example of steps for manufacturing a surface fastener of the invention.

In order to apply synthetic resin material to the woven surface fastener as described above in the embodiment, a heating area 11 is provided in the vicinity of a cloth fell portion of a loom 10, as shown in FIG. 2. A roller coating portion 12 which has a scraper 13 and coats synthetic resin material on the back face of the surface fastener is provided downstream of the heating area 11. An air nozzle 14 is disposed downstream of the roller coating portion 12 to be adjacent to the roller coating portion 12 and to face the rear face of the surface fastener. A tape loom is usually used as the loom 10, but a normal loom may be used.

A woven shape of the surface fastener woven by the loom 10 and having the above structure is fixed by thermally setting in the heating area, and the fastener is coated on its rear face with the synthetic resin diluted with solvent through a coating roller 12*a* of the roller coating portion 12. A thickness of the coat is adjusted by the scraper 13, thereby forming a thin film over the entire rear face of the surface fastener. When the surface fastener reaches a position where the air nozzle 14 is disposed in this state, air is sprayed on the thin film in a direction from the rear face side to the front face side to the surface fastener. By this air, the thin film formed in gaps between the respective constituting yarns 2, 3, and 4 is fractured to be gathered toward crossings of the respective constituting yarns 2, 3, and 4, thereby locally bonding the crossings and allowing the gaps to be open.

Thus, the synthetic resin material concentrates on the respective crossings of warp 2 and weft 3 and monofilament 4 for the female engaging elements 4*a* as constituting yarns of the surface fastener, and the synthetic resin material bonds the constituting yarns intensively at the crossings. Therefore, The loops 4*a* as the female engaging elements are firmly secured without getting out of shape. Furthermore, because gaps are formed between the respective constituting yarns from the front face to the rear face, and because all the monofilaments 2, 3, and 4 are transparent, the rear side of the surface fastener can be further clearly seen through from the front side.

By ensuring transparency in this manner, if the surface fastener of the embodiment is directly mounted to a portion of a bag or an outerwear where various designs or letters are provided, the designs or letters can be seen through from the front side of the fastener in the embodiment. It is also possible to provide logotypes, various designs, or letters, or colored versions of them to the back face of the surface fastener. On the other hand, because the conventional surface fastener lacks transparency, a color has to be directly applied to a front face of the fastener where the engaging elements are formed. In this case, because the color comes out or the engaging elements are deformed due to repeated use, a difference may be generated in clearness of the designs on the fastener and designs around the fastener, or the designs on the fastener may deviate from the designs around the fastener. In this point, according to the invention, because the designs and the like are applied to a face of an article to which the surface fastener is mounted and which is on the rear side of the fastener, the above problems are not generated.

Figure 3:
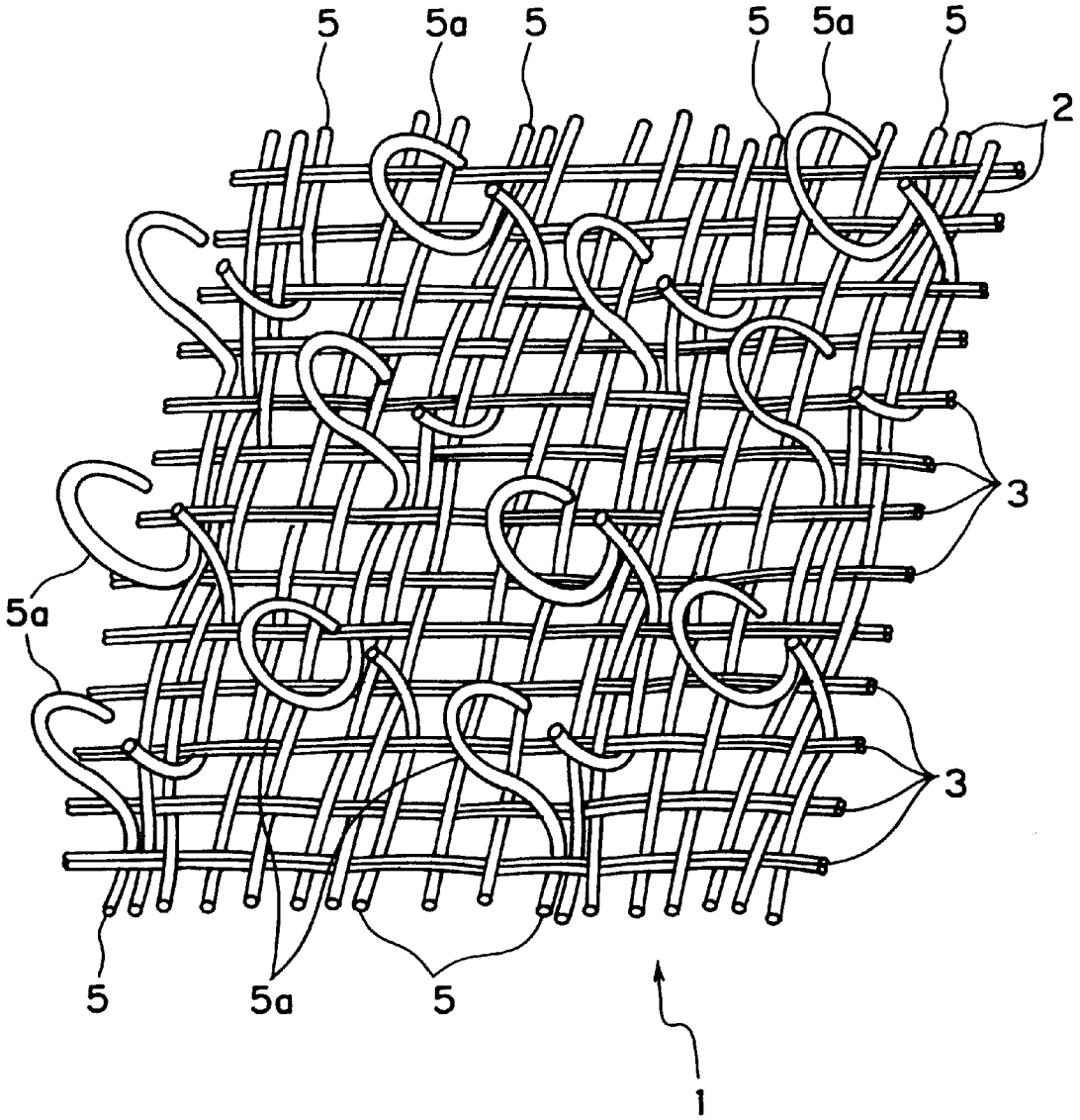
FIG. 3 is a perspective view of a portion of a male surface fastener of a second embodiment of the invention.

FIG. 3 shows a male surface fastener of a second embodiment of the invention. In this embodiment, both warp 2 and weft 3 of the ground knitted fabric 1 are monofilaments of 30 d similarly to the above first embodiment. A fineness of a monofilament 5 of a constituting yarn for male engaging elements 5*a* is 150 d, and this fineness is extremely large as compared with those of other yarns. However, it would be understood that the fineness is very small as compared with a fineness of a monofilament for conventional male engaging elements which is in a range of 200 d to 350 d.

In the present embodiment, the fineness of the monofilament 5 for the male engaging elements 5*a* is larger than those of the other constituting yarns 2 and 3 as described above so as to ensure an engaging force, but may be properly determined according to usage. However, it is desirable that the fineness of the monofilament 5 is equal to or smaller than 150 d to ensure transparency of the surface fastener as a product, and it is desirable that the fineness of the monofilament 5 is equal to or greater than 100 d to ensure a necessary engaging force. Material of the respective yarns used in this embodiment is polyester having transparency similarly to the first embodiment.

Figure 4:
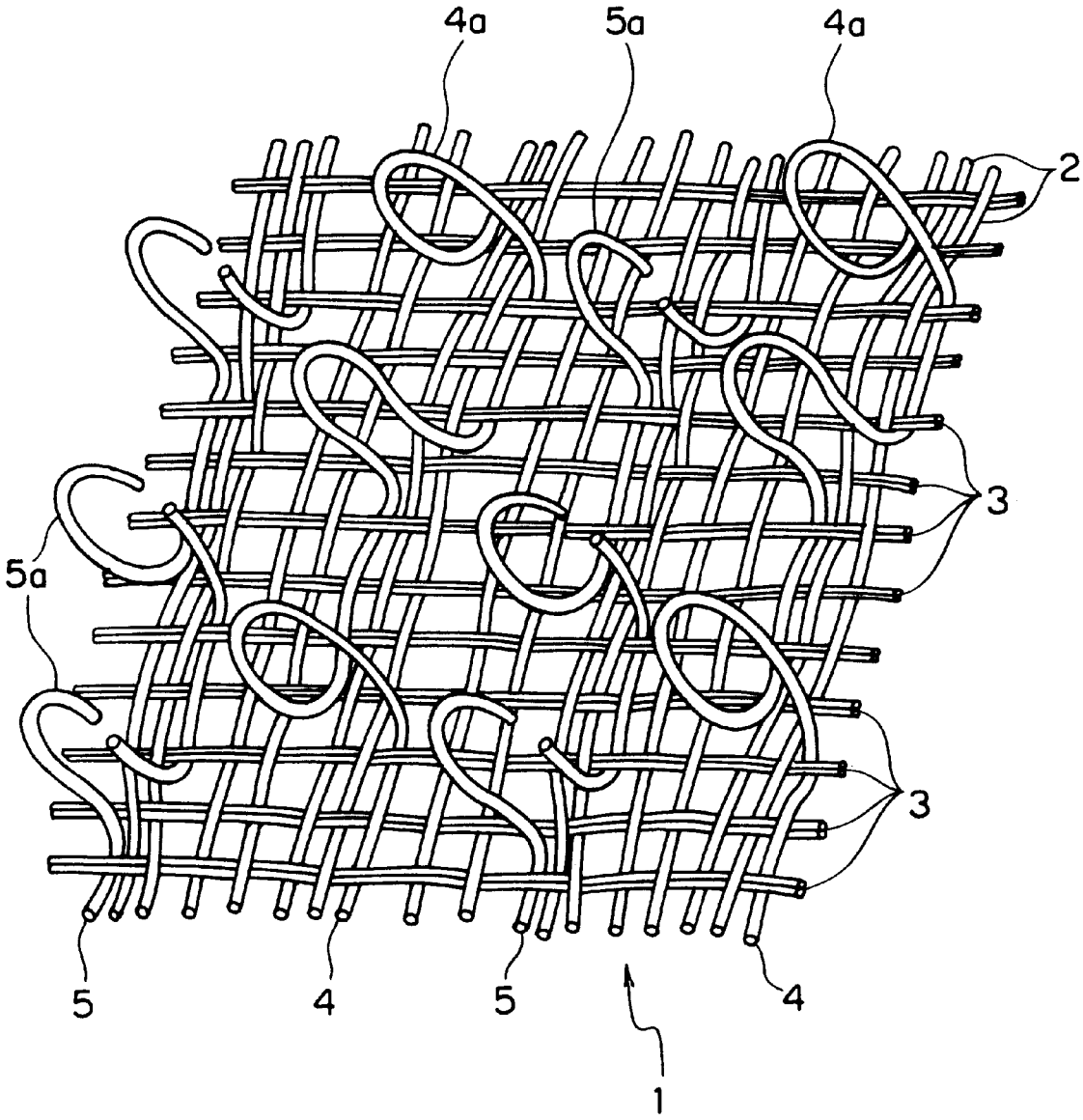
FIG. 4 is a perspective view of a portion of a surface fastener with mixed male and female engaging elements of a third embodiment of the invention.

FIG. 4 shows a self engaging type of surface fastener of a third embodiment of the invention, wherein male and female engaging elements 4*a,* 5*a* are mixed on the same surface of a ground woven fabric 1. In this embodiment, monofilaments of both warp 2 and weft 3 of the ground woven fabric 1 are 30 d similarly to the above first embodiment. A monofilament 4 as a constituting yarn of the female engaging elements 4*a* is 30 d, and a monofilament 5 as a constituting yarn streak of the male engaging elements 5*a* is 150 d similarly to the above embodiment. In this embodiment, a fineness of the monofilament 5 of the male engaging elements 5*a* is larger than those of the other constituting yarns 2, 3, and 4 as described above for the same reason as that in the above embodiment.

Thus, the woven structure of the present embodiment is substantially the same as those of the above first and second embodiments, but is different from the first and second embodiments only in that the loops 4*a* which are the female engaging elements and the loops which are the male engaging elements 5*a* are alternately disposed in a weaving width direction. In other words, every other monofilament 4 for the female engaging elements is replaced by the monofilament 5 for the male engaging elements 5*a,* and therefore, woven structures as a whole of both the monofilaments 4 and 5 are the same as those of the above first and second embodiments.

However, in this embodiment, finenesses of the monofilament 4 for the female engaging elements 4*a* and the monofilament 5 for the male engaging elements 5*a* are different from each other as described above, and in addition, the male engaging elements 5*a* are finally provided with such shapes to be engaged with the female engaging elements 4*a*. In this invention, it is unnecessary that the male engaging elements 5*a* have special shapes and functions which are different from those of the conventional male engaging elements. The male engaging element 5*a* may be a normal hook obtained by cutting a portion of the loop for the male engaging element 5*a,* or may be a so-called mushroom-shaped engaging element obtained by melt cutting an upper end of the loop and providing a hemispheric engaging head to a tip end of the cut loop.

After the loop woven fabric with the above weaving structure is woven, thermal setting and forming of a thin film on a rear face of the woven fabric are carried out similarly to the first embodiment. Then, according to a general process, the portion of each the loop for the male engaging element 5*a* is cut to form a hook 5*a* as the male engaging element. In this embodiment, flexibility and transparency are ensured in the surface fastener obtained similarly to the first embodiment, and the surface fasteners with the same structures can be joined with each other with a necessary engaging strength by pushing the fasteners against each other with their engaging element surfaces facing each other, and can be easily peeled from each other.

Figure 5:
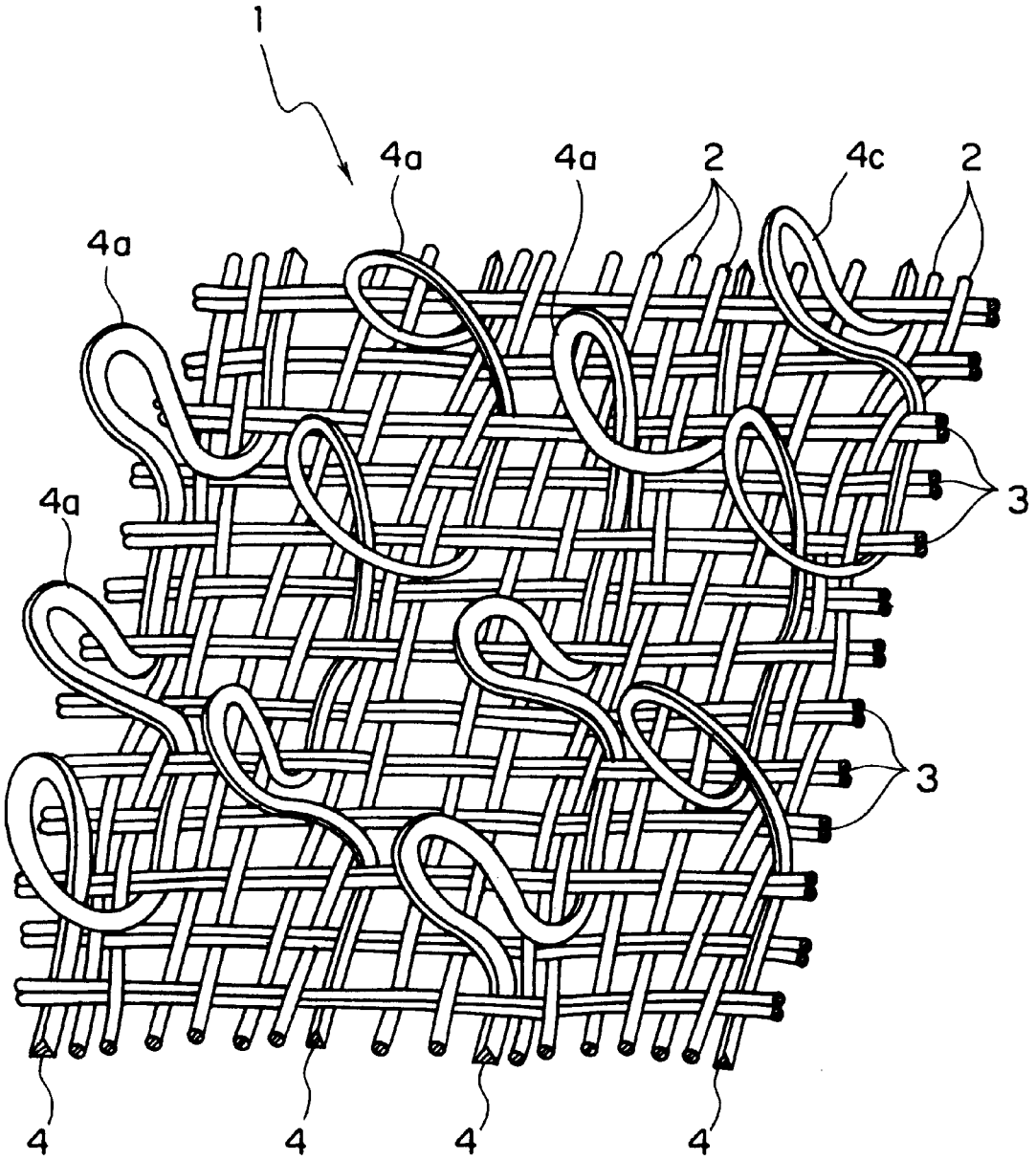
FIG. 5 is a perspective view of a portion of a female surface fastener of a fourth embodiment of the invention.

FIG. 5 shows a fourth embodiment having a woven fabric structure of a woven surface fastener according to the invention, wherein like reference numerals and/or letters are allocated to constituting elements substantially the same as those of the above embodiments. In the present embodiment, a weaving structure of the woven surface fastener is the same as that in the first embodiment and will not be described specifically.

The present embodiment is the same as the above embodiments in a point that a monofilament 4 is used as a yarn for female engaging elements 4*a*. In addition, a point which characterizes this embodiment best is that the monofilament 4 has a self-torsion property. According to the embodiment, as shown in an enlarged scale in FIG. 6, the monofilament 4 has a sectional triangular shape. Because of this sectional shape, torsion is naturally generated in the monofilament 4 due to friction applied to edge lines and forming mechanism of the loops 4*a* when the monofilament 4 is woven into the ground structure in weaving of the ground woven fabric 1 by using warp 2 and weft 3 as constituting yarns of the ground structure. The torsion concentrates on a rising base end portion of the loop 4*a*. Because of this torsion, the loops 4*a* of the monofilament 4 are firmly woven into the ground woven fabric 1 in a state wherein shapes of the loops 4*a* are stable.

The monofilament 4 has the sectional triangular shape in this embodiment, but may have any sectional shape which allows the monofilament 4 to exhibit the above torsion property. Usually, it is desirable that the sectional shape is a polygon having three or more angles. The torsion property depends not only on the shape of the monofilament 4, but torsion is generated in conjugate structure fiber obtained by compound spinning normal fiber material with high heat-shrinking property and fiber material with low heat-shrinking property arranged side by side when heated. Typical combinations of fiber material are a combination of polyester with a low drawing ratio and polyester with a high drawing ratio, and a combination of nylon 6 and nylon 66. It is desirable to select and combine kinds of synthetic resin material which have affinity with each other and belong to the same group.

On the other hand, a manufacturing process of the surface fastener of this type necessarily includes a finishing step including heating before obtaining a final product. Therefore, when the yarn which is crimped as a result of heating is used, the yarn is crimped in the finishing step without a special heating step. The torsion is generated in the rising base end portion of the loop of the monofilament 4, and the monofilament 4 firmly holds the warp 2 and/or weft 3 of the ground woven fabric 1 in a state wherein a shape of the monofilament 4 resulted from the torsion is maintained. A degree of torsion at this time can be easily determined by adjusting a ratio of materials to be combined.

Of course, a weaving structure shown here is only an example of the invention, and it is possible to form a loop 4*a* of monofilament 4 at every other weft 3, and in this case, a loop density is increased, thereby increasing the engaging rate of the female engaging elements 4*a* with the opposed male engaging elements 5*a*. In this weaving structure, it is further desirable to form the loops 4*a* such that the monofilament 4 passes over the warp line w including two warps 2 in a zigzag manner so as to direct the loops 4*a* in various directions.

Figure 6:
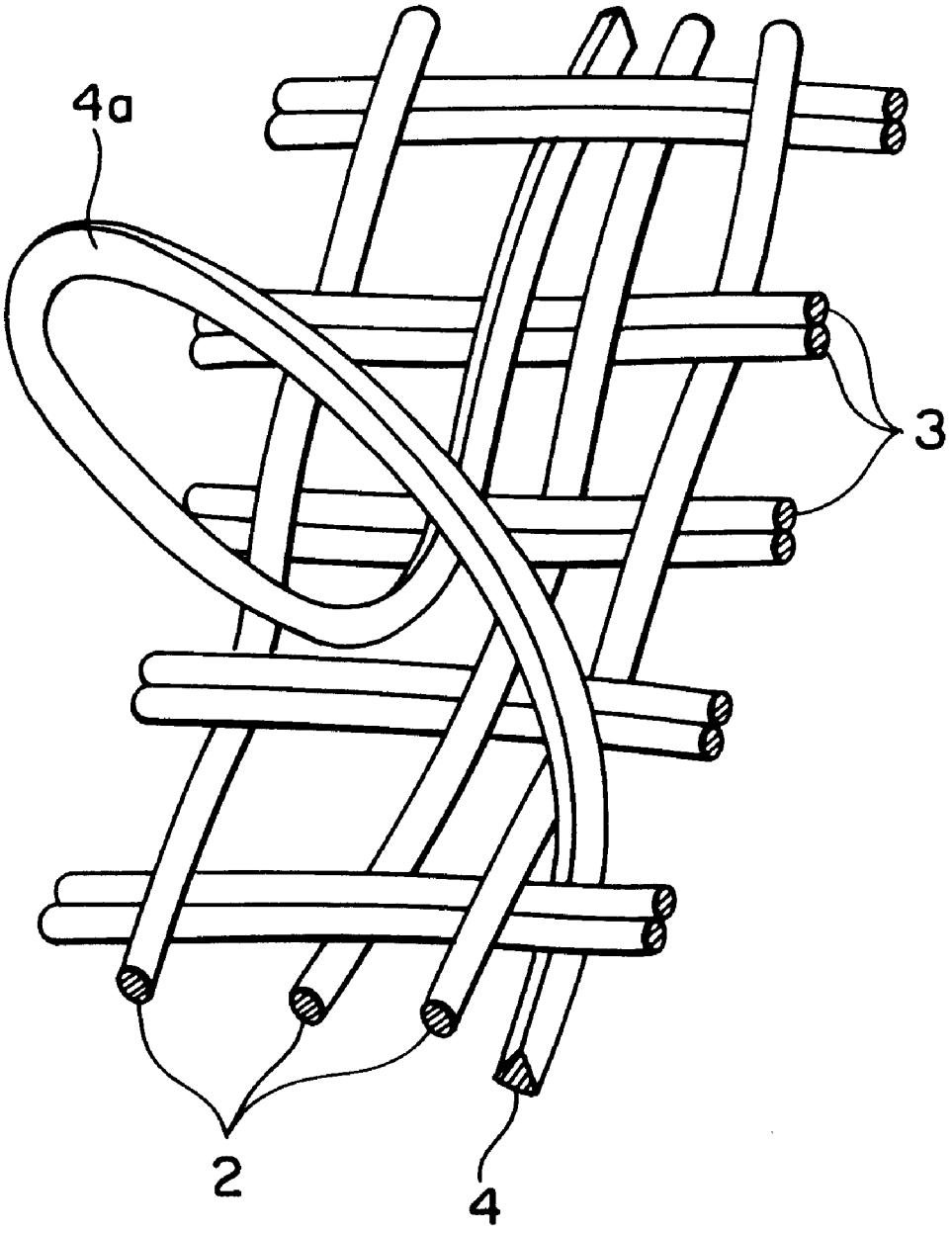
FIG. 6 is a perspective view showing a shape of a loop of the female surface fastener in an enlarged scale, of the fourth embodiment.

Thus, because the monofilament 4 is rubbed by the warp 2 and weft 3 and is carried in the weaving width direction in forming of the loops 4*a*, the torsion property is automatically applied to the monofilament 4. A shape of the monofilament 4 at this time is shown in FIG. 6. This torsion property is not necessarily generated in forming all the loops, and thus, all the formed loops 4*a* are not necessarily directed in the same direction, as shown in FIG. 5. In this point, shapes of a part of the loops 4*a* are not stably maintained.

Therefore, in the embodiment, the woven fabric woven in the above manner is thermally set on the loom according to the general process so as to fix the shapes of the loops 4*a*. Then, rein is coated on the rear face side and the base portions of the loops 4*a* are secured to the ground woven fabric 1. In order to ensure flexibility and transparency in addition to stabilizing the loop shapes, material which is highly adhesive to the respective constituting yarns and is of the same kind as the yarns is used as resin material, an amount of the resin material to be coated is set at as small value as possible, and the resin material is concentrated on portions where the projecting base portions are in contact with the ground woven fabric 1.

As described above, because the synthetic resin material is concentrated on the crossings of the warp 2 and weft 3 and the monofilament 4 for the female engaging elements 4 as the constituting yarns of the surface fastener are bonded to each other intensively at the crossings, the loops 4*a* which are the female engaging elements do not get out of shape. Furthermore, because gaps are formed to penetrate the ground woven fabric from the front face to the rear face between the respective constituting yarns and all the monofilaments 2, 3, and 4 are transparent, the rear face side of the surface fastener can be further clearly seen through from the front face.

Therefore, in this embodiment, logotypes, various designs, or letters, or colored versions of them, for example, are provided to the rear face of the surface fastener. On the other hand, because the conventional surface fastener lacks transparency, a color has to be directly applied to a face of the fastener where the engaging elements are formed. In such a case, because the color comes out or the engaging elements are deformed due to repeated use, a difference may be generated in clearness of the designs on the fastener and designs around the fastener, or the designs on the fastener may deviate from the designs around the fastener. In this point, according to the invention, because the designs and the like are applied to a face of an article to which the surface fastener is mounted and which is on the rear side of the fastener, the above problems are not generated.

Figure 7:
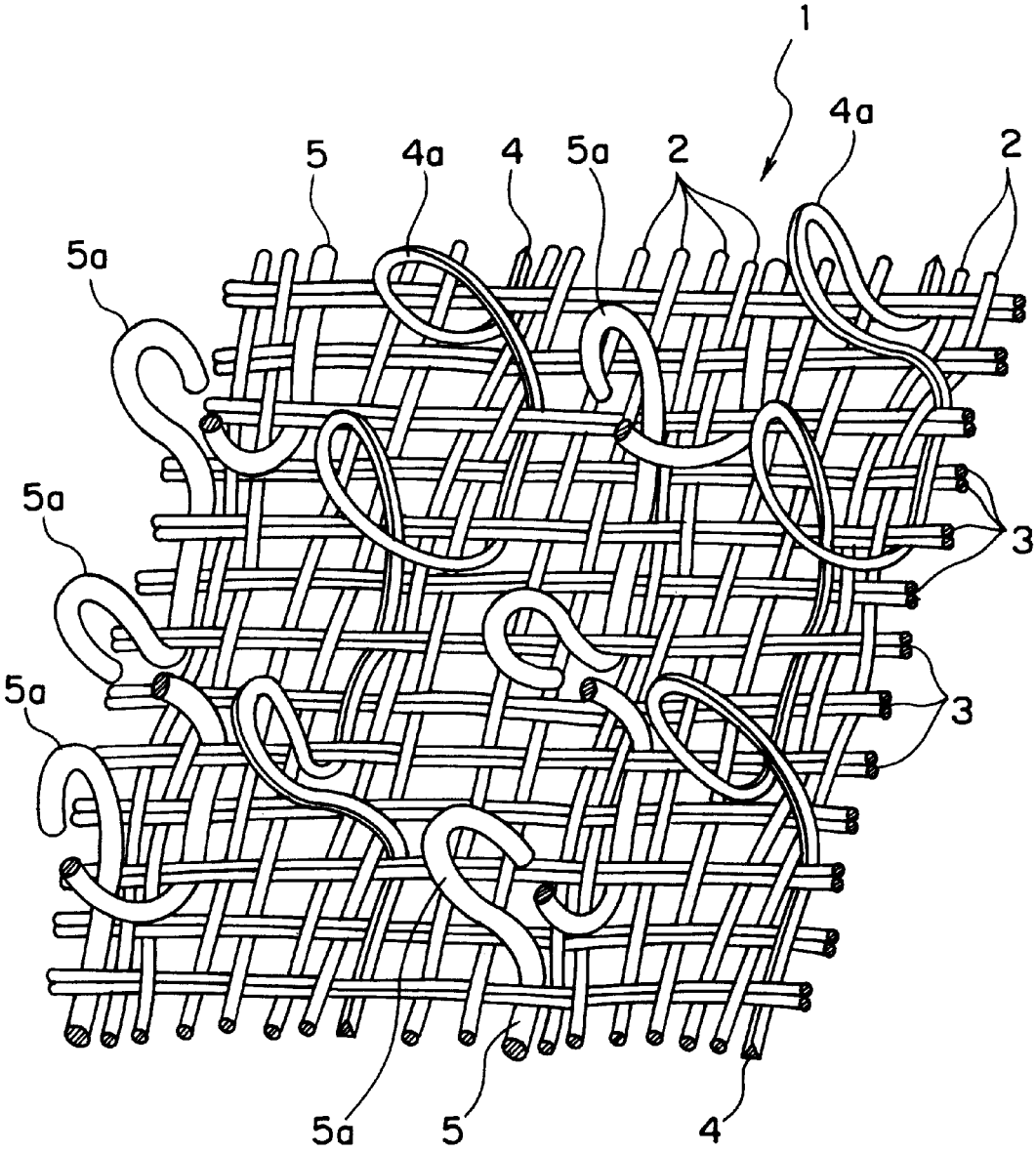
FIG. 7 is a perspective view showing a portion of a surface fastener with mixed male and female engaging elements of a fifth embodiment of the invention.

FIG. 7 shows a self engaging type of surface fastener of a fifth embodiment of the invention, wherein male and female engaging elements 4*a*, 5*a* are mixed on the same surface of a ground woven fabric 1. In this embodiment, finenesses of monofilaments of both warp 2 and weft 3 of the ground woven fabric 1 are 30 d similarly to the above first embodiment. A fineness of monofilament 4 as a constituting yarn of the female engaging elements 4*a* is 30 d, and a fineness of monofilament 5 as a constituting yarn of the male engaging elements 5*a* is 150 d. The fineness of the monofilament 5 of the male engaging elements 5*a* is extremely large as compared with those of the other yarns, but is very small as compared with a fineness of monofilament for conventional male engaging elements in a range of 200 d to 350 d.

In the present embodiment also, the fineness of the monofilament 5 for the male engaging elements 5*a* is larger than those of the other constituting yarns 2, 3, and 4 as described above so as to ensure an engaging force, but may be properly determined according to usage. However, it is desirable that the fineness of the monofilament 5 is equal to or smaller than 150 d to ensure transparency of the surface fastener as a product, and it is desirable that the fineness of the monofilament 5 is equal to or greater than 100 d to ensure a necessary engaging force. Material of the respective yarns used in the embodiment is polyester having transparency similarly to the first embodiment. Thus, the woven fabric structure of the embodiment is substantially the same as that of the above third embodiment shown in FIG. 4.

However, in this embodiment, in addition to that the finenesses of the monofilament 4 for the female engaging elements 4*a* and the monofilament 5 for the male engaging elements 5*a* are different from each other, it is unnecessary that the monofilament 5 for the male engaging elements 5*a* has a special shape or function and the monofilament 5 may be one used for normal hooks and having a circular shape in section, while the loops 4*a* as the female engaging members have a self torsion property as described above. This is because formation of the hooks described later becomes difficult if the monofilament 5 for the male engaging elements 5*a* is provided with the self torsion property similarly to the monofilament 4 for the female engaging elements 4*a*. Therefore, if the male engaging element is a so-called mushroom-shaped engaging element obtained by melt cutting an upper end of the loop and providing a hemispheric engaging head to a tip end of the cut loop, by generating torsion in the base end portions of the loops for the male engaging elements projecting from the ground woven fabric 1 as described above, the loops can be firmly mounted to the ground woven fabric 1. Therefore, it is possible to apply self torsion property to the monofilament 5 for the male engaging elements.

After the loop woven fabric having the above weaving structure is woven, the woven fabric is thermally set and formed at its rear face with a thin film similarly to the first embodiment. Then, according to the general process, a portion of each loop for the male engaging element 5*a* is cut to form a hook 5*a* which is the male engaging element. In the present embodiment, flexibility and transparency are ensured in the surface fastener similarly to the first embodiment, and the surface fasteners with the same structure can be joined to each other with a necessary engaging strength by pushing the fasteners against each other with their engaging element faces facing each other, and can be easily peeled from each other.

Although the preferable embodiments of the present invention have been described above, the invention is not limited to the embodiments, but it is possible to set the finenesses of warp and weft of the ground woven/knitted fabric at normal values when transparency and flexibility are not required, and also a weaving density may be properly selected.

What is claimed is:

1. A surface fastener made of fiber including a large number of engaging elements which are woven/knitted simultaneously with weaving/knitting of a ground woven/knitted fabric formed of a ground structure and which project from a surface of the woven/knitted fabric, wherein all of yarns constituting the ground structure and a yarn constituting the engaging elements are made of monofilament wherein synthetic resin applied to a rear face of the ground woven/knitted fabric adheres intensively to crossing portions of the monofilaments constituting yarns and the engaging elements, and gaps are formed in weaving/knitting structure of the monofilaments constituting the yarns and the engaging elements.

2. A surface fastener made of fiber according to claim 1, wherein the engaging elements include a large number of female engaging elements.

3. A surface fastener made of fiber according to claim 2, wherein the monofilament constituting the female engaging elements has a self torsion property, and torsion is generated in base end portions of the female engaging elements projecting from the woven/knitted fabric.

4. A surface fastener made of fiber according to claim 3, wherein the monofilament for the female engaging elements has a sectional shape of a polygon with three or more angles.

5. A surface fastener made of fiber according to claim 3, wherein the monofilament for the female engaging elements is crimped when heated.

6. A surface fastener made of fiber according to claim 2, wherein a fineness of the monofilament constituting the female engaging elements is in a range of 2 d to 70 d.

7. A surface fastener made of fiber according to claim 1, wherein the engaging elements are a large number of male engaging elements.

8. A surface fastener made of fiber according to claim 7, wherein a fineness of the monofilament constituting the male engaging elements is in a range of 70 d to 300 d.

9. A surface fastener made of fiber according to claim 7, wherein a fineness of the monofilament constituting the male engaging elements is in a range of 100 d to 150 d.

10. A surface fastener made of fiber according to any one of claims 1 to 3, wherein the large number of engaging elements comprise loop-shaped female engaging elements and hook-shaped or mushroom-shaped male engaging elements, and the female and male engaging elements exist in a mixed state.

11. A surface fastener made of fiber according to claim 10, wherein finenesses of the yarns constituting the ground structure are in a range of 2 d to 100 d, a fineness of the monofilament constituting the female engaging elements is in a range of 2 d to 70 d, and a fineness of the monofilament constituting the male engaging elements is in a range of 70 d to 300 d.

12. A surface fastener made of fiber according to clam 1, wherein finenesses of the yarns constituting the ground structure are in a range of 2 d to 100 d.

13. A surface fastener made of fiber according to claim 1, wherein the ground structure is formed of a weaving structure including warp and weft, a fineness of the warp is in a range of 2 d to 100 d, and a fineness of the weft is in a range of 30 d to 100 d.

14. A surface fastener made of fiber according to claim 13, wherein the fineness of the warp is in a range of 15 d to 70 d.

15. A surface fastener made of fiber according to claim 1, wherein all of the monofilaments are made of transparent or semitransparent material.

16. A method for manufacturing a surface fastener made of fiber including a large number of engaging elements which are woven/knitted simultaneously with weaving/knitting of a ground woven/knitted fabric formed of a ground structure and which project from a surface of the woven/knitted fabric, wherein all of the yarns constituting the ground structure and a yarn constituting the engaging elements are made of monofilament, said method comprising the steps of:

(a) weaving or knitting monofilament which is constituting material of female and/or male engaging elements while forming loops on a surface of the ground woven/knitted fabric simultaneously with weaving/knitting of the ground woven/knitted fabric by using the yarns made of monofilament, (b) thermally setting the completed woven/knitted fabric to fix a weaving/knitting shape, (c) coating synthetic resin material on a rear face of the set woven/knitted fabric to form a thin film, (d) spraying air on the film in a direction from the rear face side to a front face side of the woven/knitted fabric to concentrate the film on crossings of respective constituting yarns of the woven/knitted fabric, and (e) forming gaps by the concentration of the film through the surface fastener in a direction from the front face to the rear face between the respective constituting yarns.

17. A method for manufacturing a surface fastener made of fiber according to claim 16, further including a step of cutting a portion of each of the loop which is constituting material of the male engaging element.

* * * * *